US006098445A

United States Patent [19]

Meis

[11] Patent Number: 6,098,445

[45] Date of Patent: Aug. 8, 2000

[54] VEHICLE HOLDING SYSTEM

[76] Inventor: William J. Meis, 23590 Old Lincoln Hwy., Crescent, Iowa 51526

[21] Appl. No.: 09/067,712

[22] Filed: Apr. 28, 1998

[51] Int. Cl.[7] ..... B32J 13/08

[52] U.S. Cl. ..... 72/457; 72/295; 72/305; 72/457

[58] Field of Search ..... 72/457, 705, 447, 72/293, 295, 305, 316

[56] References Cited

U.S. PATENT DOCUMENTS

| | | | |
|---|---|---|---|
| 2,013,785 | 9/1935 | Merrill | 153/32 |
| 4,236,400 | 12/1980 | Specktor | 72/461 |
| 4,337,636 | 7/1982 | Clausen | 72/457 |
| 4,344,314 | 8/1982 | Aldrich et al. | 72/461 |
| 4,400,969 | 8/1983 | Specktor | 72/457 |
| 4,510,790 | 4/1985 | Hare | 72/705 |
| 4,520,649 | 6/1985 | Barton, Sr. | 72/457 |
| 4,585,198 | 4/1986 | Chartier et al. | 248/352 |
| 4,823,589 | 4/1989 | Maxwell, Jr. et al. | 72/457 |
| 4,930,333 | 6/1990 | Marbury | 72/705 |
| 4,941,765 | 7/1990 | Horan et al. | 403/107 |
| 4,986,107 | 1/1991 | Peyret | 72/705 |
| 5,131,257 | 7/1992 | Mingardi | 72/705 |
| 5,415,023 | 5/1995 | Hinson | 72/457 |

*Primary Examiner*—Ed Tolan
*Attorney, Agent, or Firm*—Zarley, McKee, Thomte Voorhees & Sease; Dennis L. Thomte

[57] ABSTRACT

A vehicle holding system for use with a vehicle frame straightener including a vehicle supporting rack and one or more pulling towers positioned adjacent thereto. The system of this invention comprises a pair of elongated cross bars which are secured to the rack and which extend between the sides thereof. A pair of blocking sockets are selectively mounted on each of the cross bars. Each of the locking sockets has a socket insert sleeve positioned therein which has a blocking upright mounted therein. Various components may be either secured to the sleeve or to the blocking uprights to block or hold the vehicle frame during the straightening operation.

18 Claims, 6 Drawing Sheets

VEHICLE HOLDING SYSTEM

BACKGROUND OF THE INVENTION

1. Field of the Invention

This invention relates to a vehicle holding system and more particularly to a vehicle holding system for use on a drive-on frame rack.

2. Description of the Related Art

Frame racks are used to straighten the frames of damaged or wrecked vehicles. The conventional frame racks of the drive-on type normally include a vehicle supporting rack means having one or more pulling towers positioned adjacent thereto. The pulling towers have chains extending therefrom for connection to the frame to pull the frame into alignment. A problem associated with the conventional frame racks is that there is not an adequate means for blocking or locking the frame of the vehicle into position during the pulling operation. The lack of an adequate vehicle holding system for use with drive-on frame racks results in a less than efficient frame rack. In some cases, in an effort to hold the vehicle into position during the pulling operation, several chains are utilized in a futile attempt to hold the frame into position. Sometimes, blocks of wood are also utilized in an attempt to prevent the frame from being pulled downwardly during the pulling operation.

SUMMARY OF THE INVENTION

A vehicle holding system is described for use with a vehicle frame straightening apparatus including a vehicle supporting rack means having a forward end, a rearward end, opposite sides, an upper surface, and one or more pulling towers positioned adjacent thereto. The vehicle holding system of this invention normally includes at least one elongated cross bar or support member which is selectively positioned on the upper surface of the rack means and which extends between the sides thereof with the ends of the cross bar being secured to the sides of the rack means. One or more upstanding blocking sockets or supports are selectively slidably mounted on the cross bar which have a socket formed in the upper end thereof for removably receiving a variety of blocking or holding members therein. The lower end of the blocking socket has an opening formed therein which selectively slidably receives the cross bar. Any number of different blocking or holding members may be installed in the socket of the upstanding blocking socket to block and lock the frame of the vehicle in place during the frame pulling or straightening operation.

It is a principal object of the invention to provide an improved vehicle holding system for use with a vehicle frame straightening apparatus.

Still another object of the invention is to provide a vehicle holding system which may be used on a variety of different frame vehicle straightening racks.

Still another object of the invention is to provide a vehicle holding system for use with a vehicle frame straightening apparatus which is easily positioned on and secured to the rack of the vehicle frame straightening apparatus.

Still another object of the invention is to provide a vehicle holding system including means for positively locking and blocking the frame of the vehicle in position.

Still another object of the invention is to provide a vehicle holding system for use with a frame rack which prevents the vehicle frame from being pulled downwardly relative to the frame rack during the pulling operation.

Still another object of the invention is to provide a vehicle holding system for use with a frame rack which substantially reduces the time normally required for a frame straightening operation.

These and other objects will be obvious to those skilled in the art.

DESCRIPTION OF THE PREFERRED EMBODIMENT

Figure 1:
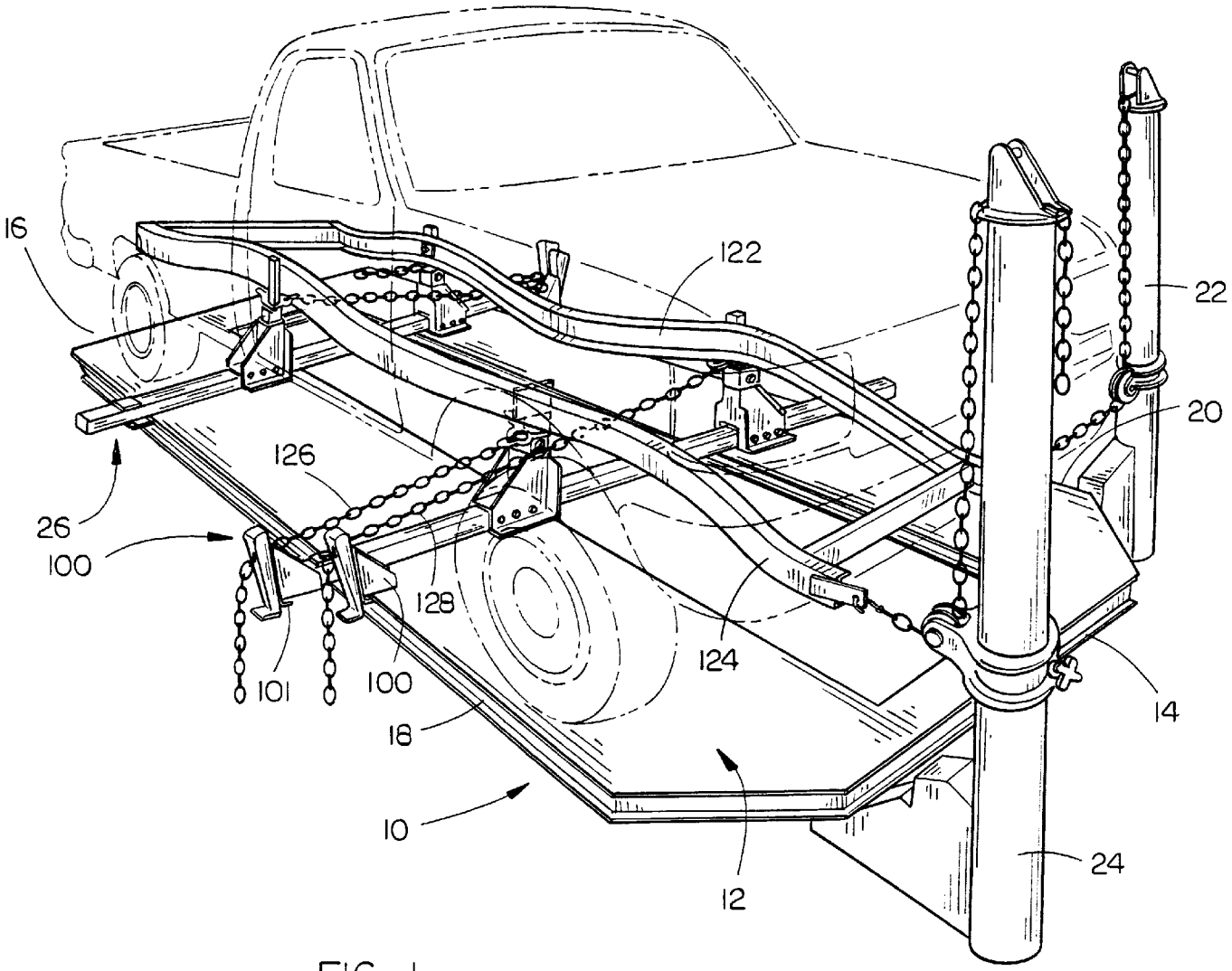
FIG. 1 is a perspective view of a conventional drive-on frame rack which is used to repair or straighten the frame of a damaged or wrecked vehicle with the broken lines indicating a truck mounted thereon.
Figure 2:
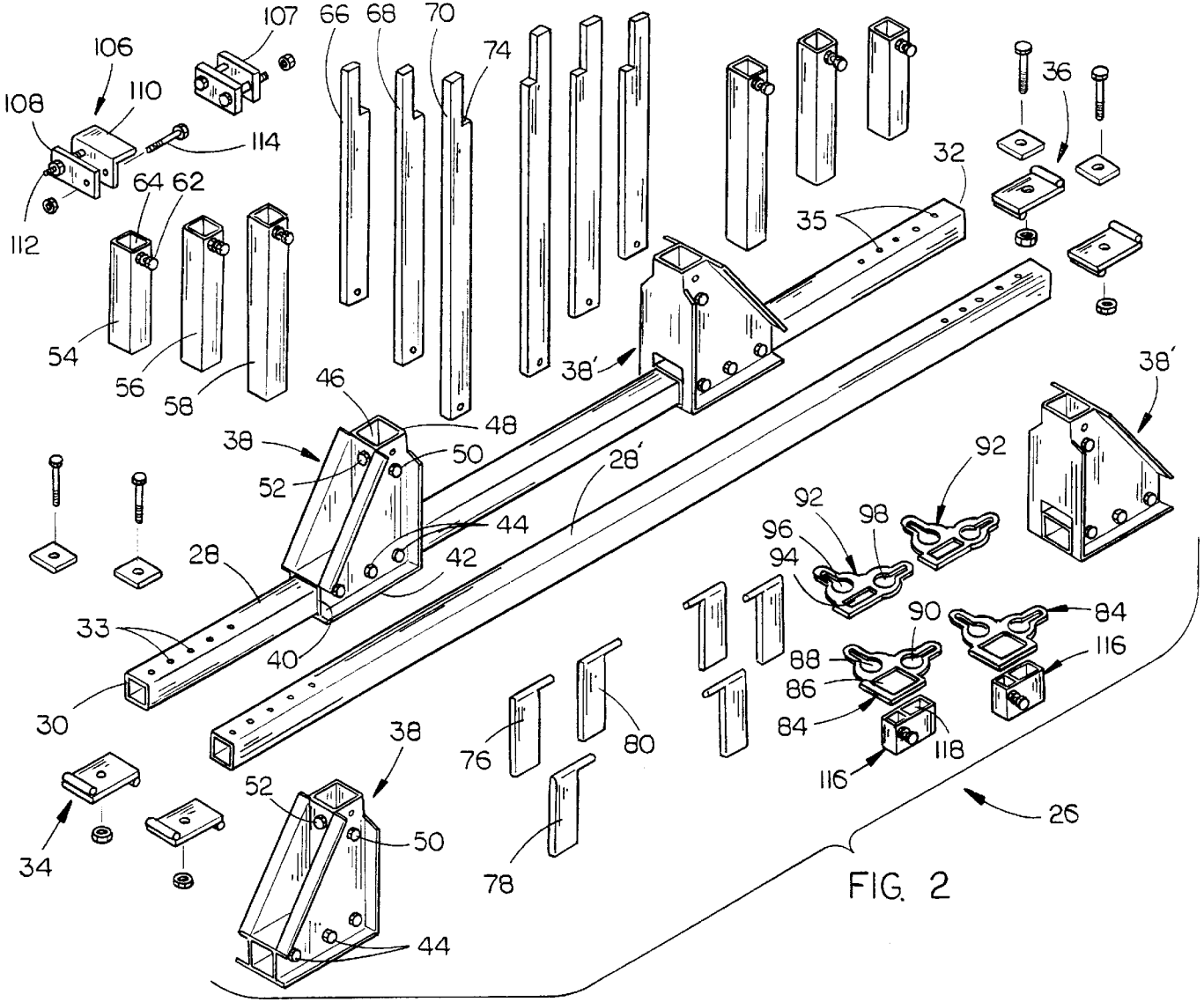
FIG. 2 is a perspective view of the components of the vehicle holding system of this invention.
Figure 3:
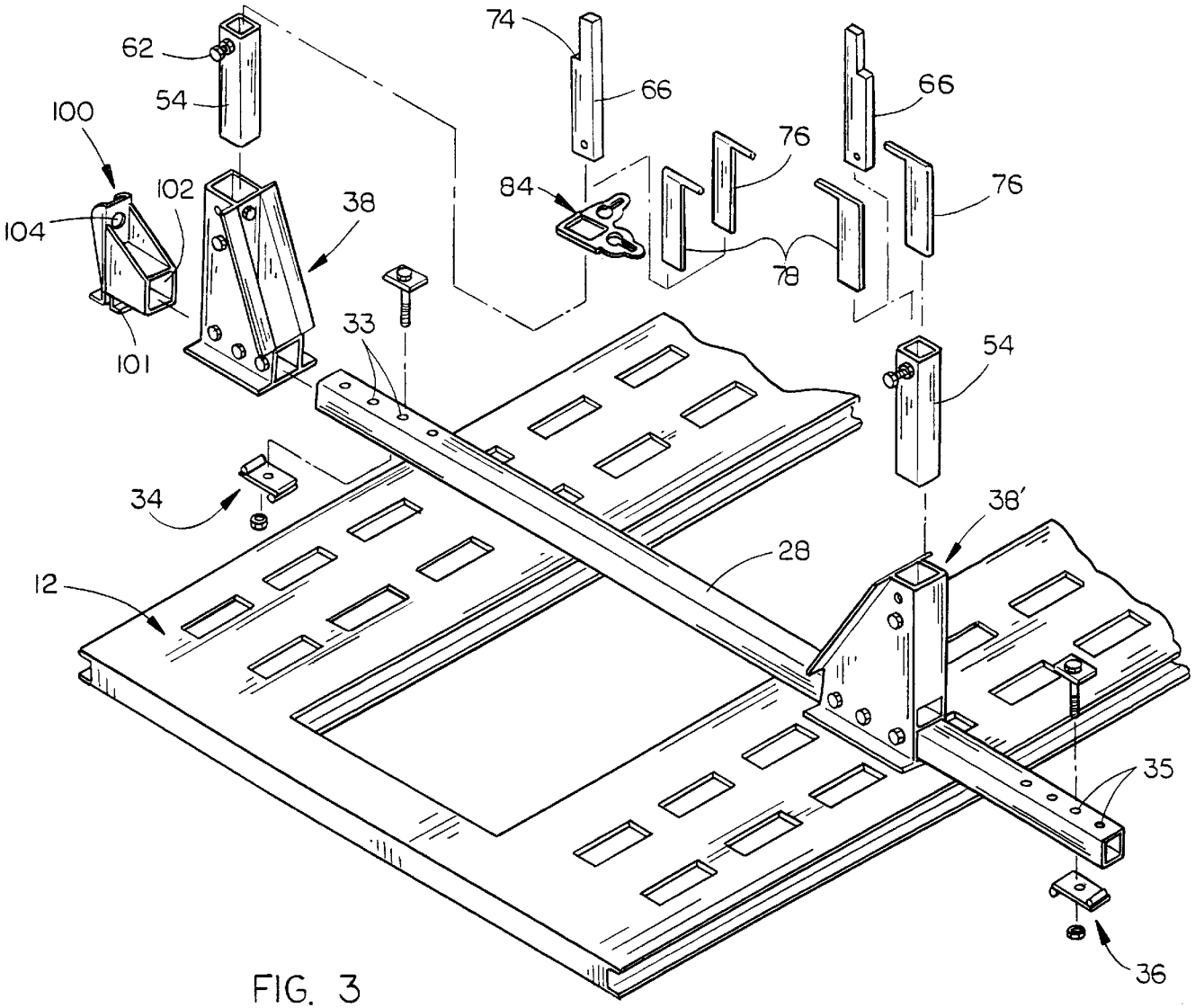
FIG. 3 is a partial exploded perspective view illustrating components of the system of this invention and their relationship to the frame rack.

The numeral 10 refers to a conventional drive-on frame rack which is used to repair or straighten the frame of a damaged or wrecked vehicle. Rack 10 includes a vehicle supporting rack means 12 having a forward end 14, rearward end 16, opposite sides 18 and 20, and pulling towers 22 and 24 positioned adjacent thereto. The number of pulling towers will vary with the particular rack. The frame rack described hereinabove is of conventional design.

Figure 4:
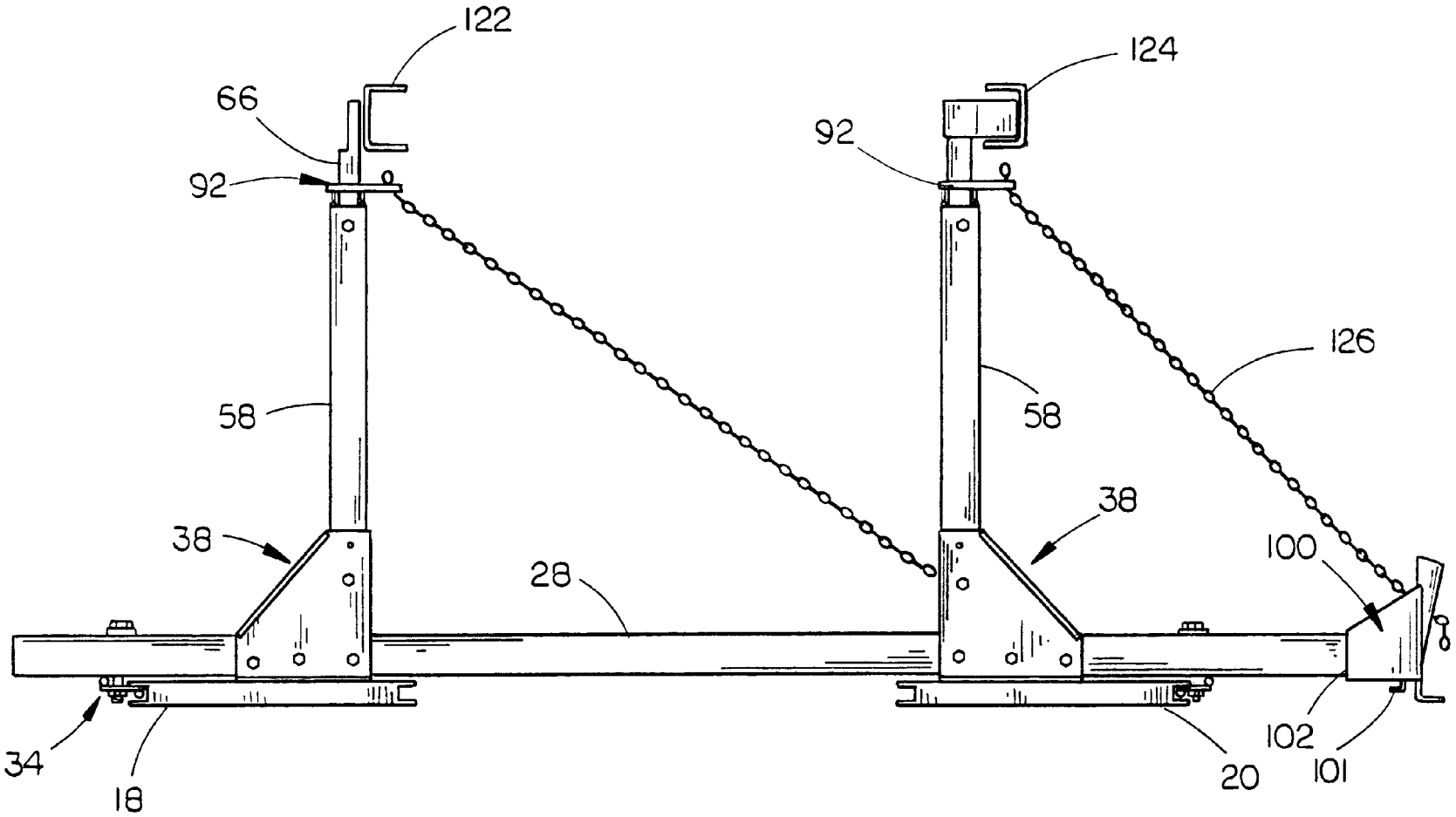
FIG. 4 is an end view illustrating components of the system mounted on a frame rack.

The universal vehicle holding system of this invention is referred to generally by the reference numeral 26 and includes many component parts thereof which will now be described in detail. System 26 includes an elongated cross bar 28 which has a generally square cross section. The ends 30 and 32 of cross bar 28 are provided with a plurality of spaced-apart openings 33 and 35 formed therein to enable cross bar tie down assemblies 34 and 36 to be adjustable mounted thereon to secure the ends of the cross bar 28 to the sides 18 and 20 of the rack means 12, respectively, as seen in FIG. 4. Usually, a pair of blocking sockets 38 and 38' are mounted on cross bar 28, but in some situations only a single blocking socket 38 may be used. Inasmuch as blocking sockets 38 and 38' are identical, only blocking 38 will be described in detail with "'" indicating identical structure on blocking socket 38'.

Blocking socket 38 has a square opening 40 formed therein adjacent its lower end 42 which slidably receives cross bar 28 therein. A plurality of bolts 44 are threadably mounted on the side of blocking socket 38 with the inner ends thereof extending into opening 40 to enable blocking socket 38 to be selectively locked in place on cross bar 28. Blocking socket 38 also has a square socket 46 extending downwardly into the upper end 48 thereof. Bolt 50 is threadably mounted on the side of blocking socket 38 with the inner end thereof extending into socket 46 to enable a component positioned in socket 46 to be locked in place therein. Preferably, a bolt 52 is also threadably mounted on blocking socket 38 at the outer end thereof which also extends into socket 46 to further lock the component in socket 46.

Many different types of components or "tools" may be mounted in socket 46. For example, the numerals 54, 56 and 58 refer to socket insert sleeves of different lengths which may be inserted into socket 46. Each of the sleeves 54, 56 and 58 has a bolt 62 threadably mounted thereon at the upper end thereof which extends into the interior 64 of the sleeve to enable a component received in the sleeve to be locked therein. The numerals 66, 68 and 70 refer to blocking uprights of different lengths which may be inserted into any of the socket insert sleeves 54, 56 and 58. As seen, each of the uprights 66, 68 and 70 is provided with a shoulder or ledge 74 adjacent the upper ends thereof. The numerals 76, 78 and 80 refer to socket insert sleeve spacers which are included in the system and which may be inserted into any of the socket insert sleeves 54, 56 or 58. Socket insert blocking sleeve tie back ring 84*s* include a square opening 86 formed therein to enable ring 84 to be mounted on any of the sleeves 54, 56 and 58. Ring 84 also includes chain retaining openings 88 and 90 to enable a chain to be received thereby. Upright tie back ring 92 includes an opening 94 formed therein to enable the ring 92 to be mounted on any of the blocking uprights 66, 68 and 70. Ring 92 also includes chain retaining openings 96 and 98 formed therein to enable a tie back chain to be received thereby. One or more chain slack removing sockets 100 are also provided in the system for removing slack from a chain. Socket 100 includes an elongated opening 102 formed in its lower end for receiving the end of a cross bar 28. Socket 100 also includes a chain retaining opening 104 formed therein for receiving the end of a chain therein. Socket 100 also includes a bracket 101 extending inwardly from the lower end thereof to enable the socket 100 to be mounted on one of the sides of the rack.

One or more upright locking clamps 106 comprised of clamp members 108 and 110, which may be drawn together by bolts 112 and 114, may be included in the system for mounting on any of the blocking uprights 66, 68 and 70. Additionally, one or more upright locking clamps 107, which may be drawn together by bolts, may also be included in the system for mounting on any of the blocking uprights 66, 68 and 70. Further, a "C" frame attachment 116 may be mounted on any of the uprights 66, 68 and 70 with the opening 118 in the attachment 116 receiving the upright. A set of identical components are also shown in the drawings which may be used with blocking socket 38'. While a single cross bar 28 has been described, the system would also include a second cross bar 28' and a second pair of blocking sockets, as illustrated in the drawings.

FIG. 1 illustrates the system 26 of this invention being used with the conventional drive-on frame rack 10 which is being used to repair or straighten the frame of a damaged or wrecked vehicle 120 including a left side frame member 122 and a right side frame member 124. As stated, normally a pair of the cross bars 28 and 28' will be utilized in most pulling operations. Cross bar 28 is extended through the openings 40 in the blocking sockets 38 and 38' with the cross bar 28 being extended beneath the frame of the vehicle in the approximate desired location. Any of the socket insert sleeves 54, 56 and 58 may be inserted into the socket 46 and socket 46', depending upon the particular vehicle frame being straightened. Bolts 50 and 52 are tightened to maintain the socket insert sleeve in the socket 46. Any of the blocking uprights 66, 68 and 70 may be inserted into the open upper end of the socket insert sleeve, depending upon the height of the frame member at the location where the blocking and holding operation will occur. Normally, a socket insert sleeve spacer 76 will be inserted downwardly into the open upper end of the socket insert sleeve at one side of the blocking upright positioned in the socket insert sleeve, while a second socket insert sleeve spacer will be inserted into the open upper end of the socket insert sleeve at the opposite side of the blocking upright. In some cases, a pair of the socket insert sleeve spacers will be positioned at one side of the blocking upright. Bolt 62 is then tightened to firmly maintain the blocking upright in position in the socket insert sleeve. Assuming that no other attachments are going to be positioned on the blocking upright, the cross bar tie down assemblies 34 and 36 will be clamped onto the opposite sides of the rack to firmly maintain the cross bar 28 in its proper position. The bolts 44 on the blocking sockets will also be tightened to prevent slippage of the blocking socket with respect to the cross bar 28.

In some cases, a chain slack removing socket 100 will be slipped onto the outer end of the cross bar 28, as illustrated in FIG. 1. The chain slack removing socket 100 is utilized when it is desired to utilize an upright tie back ring 92 which has been slipped over the upper end of the blocking upright with the chain 126 extending between a tie back ring 92 and the chain slack removing socket 100. Further, in some cases, a second chain slack removing socket 100 may be utilized with that socket being positioned at the side edge of the rack with the bracket 101 extending beneath the upper surface of the rack. Chain 128 may then be extended between the socket 100 and a tie back ring positioned on the blocking upright positioned outwardly of side frame member 122, as illustrated in FIG. 1. The chains 126 and 128 further stabilize the blocking uprights during the subsequent operation. As seen in FIG. 1, the blocking upright 38 at the left side of the vehicle is positioned outwardly of the side frame member 122 in this particular pulling operation. As seen in FIG. 4, in an effort to prevent damage to the inner edges of the side frame member 124, an upright "C" frame attachment 116 is slipped onto the upper end of the upright with the inner end of attachment 116 engaging the inside surface of the frame member 124 rather than the edges of the frame member.

Figure 6:
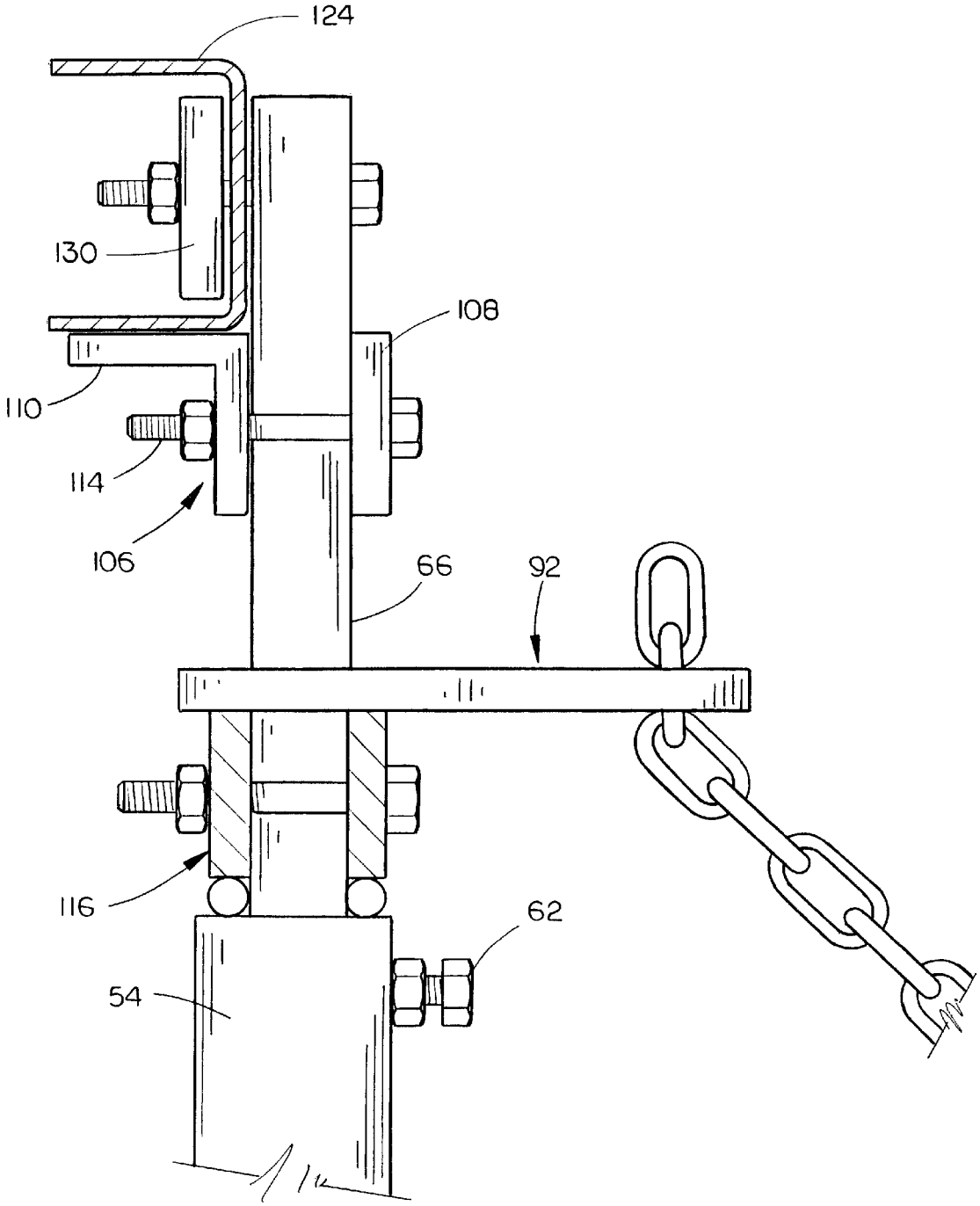
FIG. 6 is an end view illustrating certain of the components of this system.

FIG. 6 illustrates the manner in which the tie back ring 92 may be vertically positioned on the upright 66. As seen in FIG. 6, an upright locking clamp 106 is clamped onto the upright 66 with the tie back ring 92 being limited in its downward movement by the locking clamp 106. FIG. 6 also illustrates the manner in which a frame member 122 or 124 may also be secured to the upright 66 so that the member 100 is positioned below the frame member 124 to prevent the frame member from being pulled downwardly during the pulling operation. FIG. 6 also illustrates that an upright backing block 130 may be connected to the frame member and the upper end of the upright.

Figure 5:
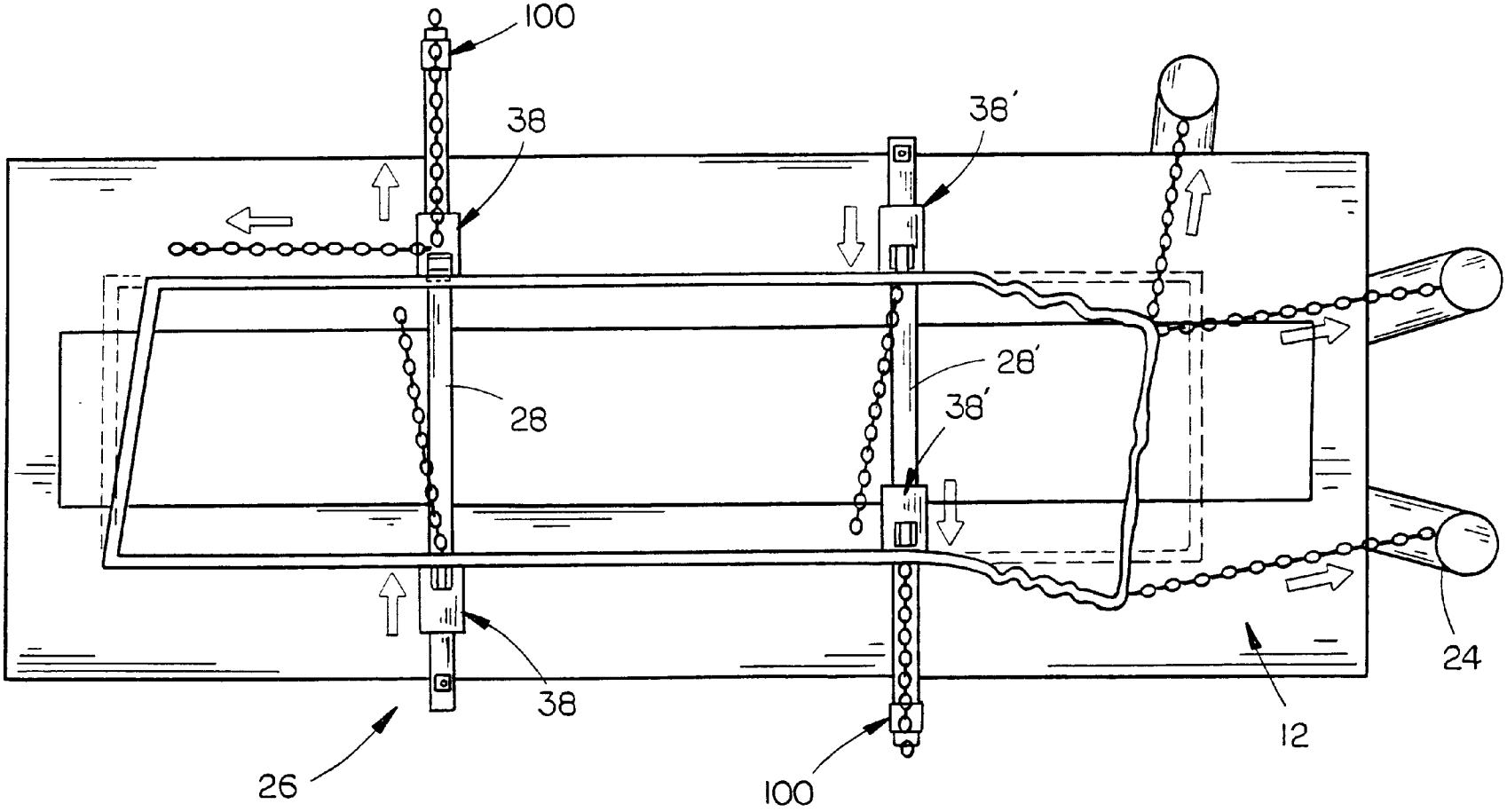
FIG. 5 is a top view illustrating the system of this invention being used in conjunction with the frame rack.

FIG. 5 illustrates the holding system of this invention being utilized for removing a front end sway and diamond in the frame. The system of this invention is holding the left frame member of the vehicle secure so that it can't move. The system is also holding the rearward end of the right side frame member against outward movement as the pulling operation is being conducted. FIG. 5 also illustrates that the inside of the right side frame member is being held from moving inwardly during the pulling operation, since the upright is positioned at the inside surface of the frame member. The pulling towers then pull the front of the frame to the lift into its correct position, as illustrated by broken lines. The pulling operation also results in the left rear portion of the frame being moved rearwardly to its proper position, as illustrated by broken lines.

Thus it can be seen that a novel vehicle holding system has been provided for use with a frame rack so that the frames of damaged or wrecked vehicles may be straightened. The holding system of this invention holds the vehicle in position during the pulling operation to keep the same from moving around on the frame rack. Further, the holding system of this invention prevents the frame of the vehicle from being pulled downwardly towards the rack during the pulling operation.

Thus it can been seen that the invention accomplishes at least all of its stated objectives.

I claim:

1. A vehicle holding system for use with a vehicle frame straightening apparatus including a vehicle supporting rack means having a forward end, a rearward end, opposite sides, an upper surface, and at least one pulling tower positioned adjacent thereto, the vehicle holding system comprising:

at least one elongated support member selectively positioned on said upper surface of said rack means which extends between the sides thereof;

at least one upstanding support selectively slidably mounted on said support member and having a vertically disposed socket at its upper end;

a frame-engaging member removably selectively received in said socket;

said frame-engaging member adapted to be positioned adjacent the vehicle frame and laterally thereof without being secured to the vehicle frame to enable the frame-engaging member to block or hold the frame against lateral movement during the straightening of the frame;

first means for securing the ends of said support member to said rack means;

and second means for securing said support to said support member.

2. The system of claim 1 wherein said support includes upper and lower ends and wherein said lower end of said support has an opening formed therein which selectively slidably receives said support member therein.

3. The system of claim 2 wherein said second means comprises a bolt means threadably mounted on said support which may be threadably moved into engagement with said support member to prevent movement of said support with respect to said support member.

4. The system of claim 1 wherein a pair of supports are mounted on said support member.

5. The system of claim 1 wherein said first means comprises an adjustable clamping means.

6. The system of claim 2 wherein said first means also maintains said lower end of said support in frictional engagement with said upper surface of said rack means.

7. The system of claim 1 wherein said support member comprises a square tube.

8. The system of claim 7 wherein said support has a square opening formed in its lower end for receiving said square tube therein.

9. The system of claim 1 wherein said vertically disposed socket has a generally square cross-section and wherein an elongated upstanding hollow sleeve is positioned in said socket, said sleeve having a generally square cross-section.

10. The system of claim 9 wherein means is provided on said support for selectively maintaining said sleeve in said socket.

11. The system of claim 9 wherein an elongated bar is selectively mounted in said sleeve which extends upwardly therefrom for engagement with the frame of the vehicle being repaired.

12. The system of claim 9 wherein a chain tie back ring is selectively secured to said sleeve.

13. The system of claim 9 wherein a frame support block is selectively secured to said elongated bar.

14. The system of claim 9 wherein a pair of support members are secured to said rack means and wherein a pair of supports are secured to each of said support members.

15. The system of claim 9 wherein a chain tie back ring is selectively secured to said elongated bar.

16. The system of claim 12 wherein a clamping means is clamped onto said elongated bar beneath said tie back ring.

17. The system of claim 1 wherein a first chain slack removing socket is removably mounted on at least one end of said support member.

18. The system of claim 17 wherein a second chain slack removing socket is removably mounted on one side of said rack means.

* * * * *